United States Patent [19]

Müller

[11] 4,142,281

[45] Mar. 6, 1979

[54] MAGNETIC ROLLER FOR ELECTROGRAPHIC DEVELOPING AND/OR REPRODUCING DEVICES

[75] Inventor: Werner Müller, Godesburg, Fed. Rep. of Germany

[73] Assignee: Magnetfabrik Bonn GmbH vorm. Gewerkschaft Windhorst, Bonn am Rhine, Fed. Rep. of Germany

[21] Appl. No.: 850,048

[22] Filed: Nov. 9, 1977

[30] Foreign Application Priority Data

Mar. 6, 1977 [DE] Fed. Rep. of Germany ..... 2725109

[51] Int. Cl.[2] ..... B21B 13/02

[52] U.S. Cl. ..... 29/116 R; 118/658; 29/132

[58] Field of Search ..... 29/110, 116 R, 129.5, 29/129; 118/657, 658

[56] References Cited

U.S. PATENT DOCUMENTS

| | | | |
|---|---|---|---|
| 3,754,526 | 8/1973 | Caudill | 118/658 |
| 3,805,550 | 4/1974 | Patton | 29/129 X |
| 3,822,139 | 7/1974 | Westdale | 118/658 X |
| 3,893,414 | 7/1975 | Hudson | 118/658 |
| 3,900,001 | 8/1975 | Fraser et al. | 118/658 |
| 3,981,271 | 9/1976 | Okada et al. | 118/658 |
| 3,988,816 | 11/1976 | Tada | 29/116 R |

*Primary Examiner*—Dorsey Newton
*Attorney, Agent, or Firm*—George H. Mitchell, Jr.

[57] ABSTRACT

The magnet carrier assembly of an electrographic copying device is fabricated from a number of separate parts instead of being machined from a single block of metal. The assembly can consist of a tubular body which supports the magnets either on the outside, or inside, peripheral surface. The tubular body can be formed by extrusion integrally with a radial spider connected to a hub which supports the body. In another form the carrier can be built up by combining specially profiled sheet metal strips with other axially extending elements with which they are joined in a tongue-in-groove arrangement.

20 Claims, 12 Drawing Figures

MAGNETIC ROLLER FOR ELECTROGRAPHIC DEVELOPING AND/OR REPRODUCING DEVICES

This invention relates to a magnetic roller for electrographic developing and/or reproducing devices with a plurality of magnet segments distributed around the circumference of the roller, which is arranged by means of an axle journal either stationarily in a nonmagnetic rotating sheathing or rotatably in a stationary sheathing.

Magnetic rollers of this type, as disclosed in German patent DT-OS No. 23 13 297, are primarily used with dry toner for the known electrostatic copying method. In this case the invention has to do with multipolar permanent magnet rollers which are mounted rotatably in a tube or in a sheathing of nonmagnetic material, or else are to be mounted stationarily in a rotating tube or a rotated sheathing so that the toner which contains magnetic component particles is distributed over the sheathing of the tube circumference in a thin layer and held, positioned and transferred by magnetic force. A "magnetic brush" for the toner material is thus formed on the cover of the sheathing and is uniformly distributed. The toner material either consists entirely of magnetic particles or contains magnetic particles which may include a colored powder. The toner material can also be electrically conductive.

The toner material is to be uniformly distributed over the nonmagnetic poles of the roller. In order to attain this, four to eight magnetic poles have until recently been distributed uniformly around the circumference of the magnetic roller. For some purposes, nonuniform distribution of the magnetic poles has also been suggested.

The manufacture of this type of magnetic roller has until now been very expensive. The roller axis is customarily made from one integral piece of bar stock with its axle fournal at one end, to which, subsequently, magnet segments are attached which are suitably cambered to fit.

An object of the invention is to simplify the manufacture of magnetic rollers and the support construction for the magnet segments and their attachment, as well as to configure their reciprocal arrangement and correlation so that they can be easily adapted to the most varied installations and uses without variation of the basic concept.

The invention first provides that the magnet segments of the magnetic roller are attached on, or in a carrier tube with a uniform or nonuniform, multiangular profile and in either uniform or nonuniform spacings with radially outwardly directed magnetization, with axial cutouts provided at the ends of the carrier tube to receive the axle journal.

The mounting of the magnet segments according to the invention on a carrier tube instead of on a solid axle or roller simplifies and makes less costly not only the manufacture of the carrier construction for the magnet segment, but also makes possible a simpler and more precise manufacture of the magnet segments themselves and leads to their simpler and improved arrangement on the support construction. Also, numerous possibilities of modification in the configuration of the magnet roller and in the arrangement and reciprocal coordination of the magnet segment on the carrier construction and in relation to the sheathing surrounding the magnetic roller for the dispersion and the transfer of the toner material are attained.

Thus it is also possible to configure the magnetic roller such that the rotation axis of the roller or of the axle journal is displaced to one side relative to the longitudinal or symmetrical axis of the carrier tube.

In the practical embodiment of the invention it is provided that the carrier tube has a closed or open tube cross section with a plurality of outer or inner flat side surfaces which are disposed in the direction of the tube periphery, in the direction of the tube axis and transverse thereto, to which the magnet segments are at least partially attached. A carrier tube of this type can be covered with magnetic strips according to the desired configuration of the magnetic field, in a simple manner and on all or only on some of the side surfaces. The arrangement and alignment of the magnetic strips can thereby be simplified.

According to another feature of the invention, adjacent to or between the flat side surfaces of the support tube are provided side emplacement or orientation surfaces for the magnet segments. By the arrangement of the magnetic strips on a carrier tube, it is possible for both the form and the dimensions of the magnetic strips, the magnet material out of which the strips are made, the reciprocal coordination of the magnetic strips, as well as also their spacing to be varied according to need, so that strong magnetic poles are alternated with weak poles in a manner determined by the relevant arrangement and purpose of use. Thus the magnet poles can be distributed either on the outside or on the inside of the carrier tube, for example, so that more material is held at those peripheral segments of the sheathing which lead the toner material to positions which are being printed than on the interlying print-free areas.

The desired different strengths of the magnetic field can be produced not only by different magnetic pole strengths or thicknesses, but also by a different spacing of the magnetic poles from the rotation axis of the roller or the carrier tube or its axle journal, without necessitating the costly and complicated production and fabrication measures as in roller construction known until this time.

A particular advantage of the invention lies in that the magnet segments are provided with flat mounting surfaces. They can be cut from a magnetic plate or even be extruded and be mounted in this crude state to the flat side surfaces of the carrier tube, at the ends of which the axle journal can be previously mounted or can thereafter be inserted. If the magnetic strips are fastened on the outside of the carrier tube, then the roller need only be shifted, in order to precisely fit the outside surface of the magnet segment to the cambered inside of the surrounding sheathing.

Besides a configuration of the carrier tube with a more or less uniform or nonuniform closed or open tube profile, according to one further feature of the invention it is also possible that the carrier tube consist of profiled longitudinal sheets which are connected with each other by longitudinal strips of preferably extruded material in a tongue and groove connection. Just as with an embodiment of the carrier tube with a closed or open tube profile, the profiled longitudinal elements may consist of sheet metal or another suitably magnetic or even nonmagnetic material. The longitudinal strips connecting the longitudinal sheets could also serve as side emplacements or orientation surfaces for the magnet segments.

Since the larger size magnetic rollers can under certain circumstances lead to difficulties in the selection of dimensions of the magnet segments and in their outward oriented mounting, the carrier tube can be configured with inside supporting surfaces and ribs or the like in between them, for the mounting of the magnet segments, and can consist of nonmagnetic material, such as an alloy or plastic. In this embodiment, individual magnet segments can be connected with each other by sheets of magnetically conductive material, for reinforcement of the magnetic poles.

With this embodiment, less costly manufacture is possible even with a greater number of elements, because the carrier tube is configured as a injection die casting with an inside hub spider, and the axial cutouts to receive the axle journal are of one piece.

If the requirements for the number of elements are variable, or if the elements are to be completed from parts which are of different types of rollers with different properties, then this too can be attained according to the invention, in that hubs or the like, of nonmagnetic material such as plastic, light metal or the like, can be inserted in a stationary or rotatable arrangement of the axle journal. If the hubs are of suitable material, then no lubrication is necessary.

With proper configuration and arrangement of the hubs at the ends of the carrier tube, it can easily be provided that the rotation axis of the magnetic roller or the axle journal can be shifted sideways in relation to the longitudinal axis of the carrier tube, in order to attain a suitable variation of the magnetic field strength resulting from the turning of the magnetic roller or of the sheathing surrounding a fixed roller.

It has been disclosed as particularly useful that the magnet segments be configured as plastic-bound magnetic strips of barium ferrite, rare earth metal-cobalt-alloys or other high strength magnetic materials. The magnet segments could be mounted on the carrier tube or on its flat side surfaces with adhesive.

Preferred embodiments of the invention are shown in the drawings, in which.

Figure 1:
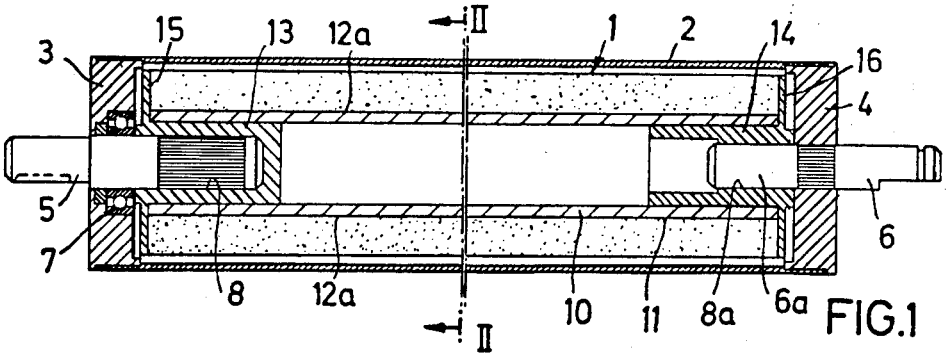
FIG. 1 shows a longitudinal cross section through a magnetic roller along line I—I in FIG. 2.

As shown in the drawing, magnetic roller 1 is mounted rotatably in a stationary sheathing 2 or can be stationary in a rotating sheathing 2. The sheathing 2 consists of a nonmagnetic material, such as light metal or plastic, and is closed at both ends by caps 3, 4, through which project the axle journals 5, 6 of the coaxially aligned magnetic roller. Cap 3 of sheathing 2 is mounted to be rotatable by means of a ball bearing 7 in relation to axle journal 5, which is mounted in an axial cutout 8 on magnetic roller 1, while axle journal 6 is mounted in cap 4 on the opposite end of sheathing 2 and projects with its inward end **6*a* into another axial cutout 8*a* on the side of magnetic roller 1**, so that it can rotate.

Magnetic roller 1 consists also of a carrier tube 10, which can have a uniform, or nonuniform, multiangular profile, on the flat side surfaces 11 of which are mounted a plurality of magnet segments 12, with the same, or different dimensions and as necessary with variable, radially outwardly aligned magnetization in uniform, or nonuniform, spacing. Side surfaces 11 are angled away from each other.

In the embodiments as in FIGS. 1 to 10, hubs 13, 14 are inserted in the ends of carrier tubes 10, and are preferably of nonmagnetic material, such as plastic, non-ferrous metal or the like, and each has a cutout 8 or **8*a* for a stationary or rotatable arrangement of both axle journals 5, 6. Sor far as is necessary for a rotatable mounting of axle journals 5, 6, the hubs of magnetic roller 1, as well as the ends of caps 3, 4** of the sheathing could consist of material with friction reducing properties, such as for example lubricant or plastic impregnated with graphite, sintered metal or the like.

Both hubs 13, 14 have outwardly aligned flanges or flange segments 15, 16, which project radially out over the outside circumference of carrier tube 10 corresponding to the thickness or height of magnet segments 12. For simpler attachment of magnet 12 to carrier tube 10, both hubs 13, 14 of flanges 15, 16 could have finger-like projections 17 with side structures or alignment surfaces **17*a* aligned parallel to the longitudinal axis of the tube 10, which surfaces border magnet segments 12 and thus serve as templates for the attachment of the magnet segments to carrier tube 10**.

Figure 2:
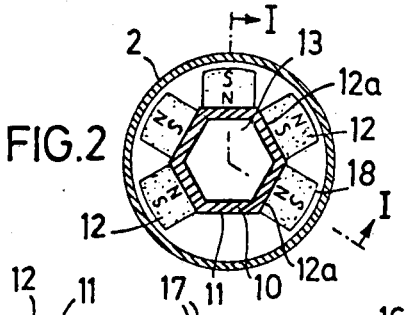
FIG. 2 shows a cross section through the roller along line II—II of FIG. 1.

Carrier tube 10 as shown in FIGS. 1 and 2 has a uniform hexagonal diameter with six flat surfaces 11, of which only five are provided with strip magnet segment 12 with alternating series of poles, so that in the area of the sixth surface 11, the otherwise uniform series of poles is interrupted and the magnetic field is varied toward the circumference of the magnetic roller. Magnetic poles 12 are adhered with their flat attachment surfaces **12*a* to surfaces 11 of tube 10 and consist preferably of plastic bound permanent magnet material of the barium ferrite, rare earth metal-cobalt-alloys type or of other high strength magnetic materials. All of the magnet segments have cambered surfaces 18 corresponding to the inside circumference of the surrounding sheathing 2. Carrier tube 10** can consist of magnetic material.

Figure 3:
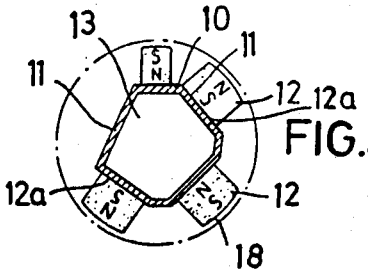
FIG. 3 shows a cross section as in FIG. 2 through a modified form of the magnetic roller.

In the FIG. 3 embodiment, carrier tube 10 also has a multiangular, essentially pentagonal profile, in which two corners are flattened, so that altogether five flat surfaces 11 are present for the attachment of magnet segments 12, of which however only four surfaces 11 are provided with strip magnet segments 12. The top magnet segment 12 in FIG. 3 is of narrower breadth than the three following magnet segments and a corresponding lower pole strength. The four magnet segments 12 are also distributed in nonuniform arrangement over the circumference of magnetic roller 1 and have a variable radial thickness, so that a corresponding nonuniform construction of the magnetic field of magnetic roller 1 results.

Figure 5:
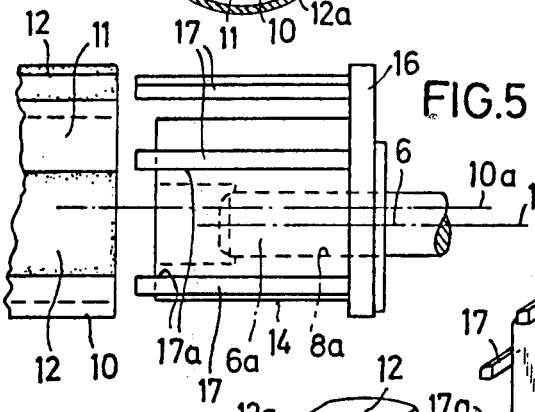
FIG. 5 shows a partial side view of this embodiment as seen from the right side in FIG. 4.
Figure 4:
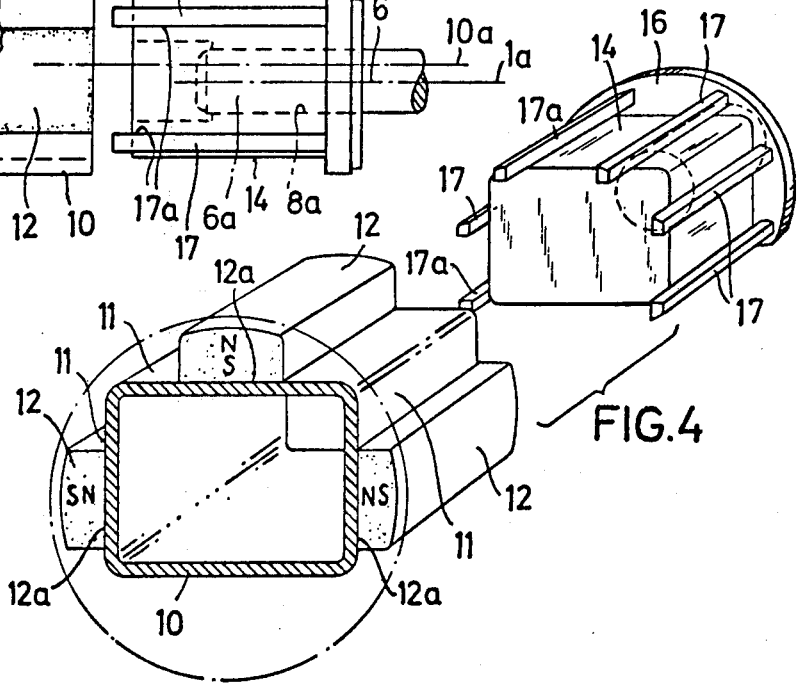
FIG. 4 shows a perspective view of another embodiment of a magnetic roller, wherein the parts of the roller are shown turned in opposite directions.
Figure 6:
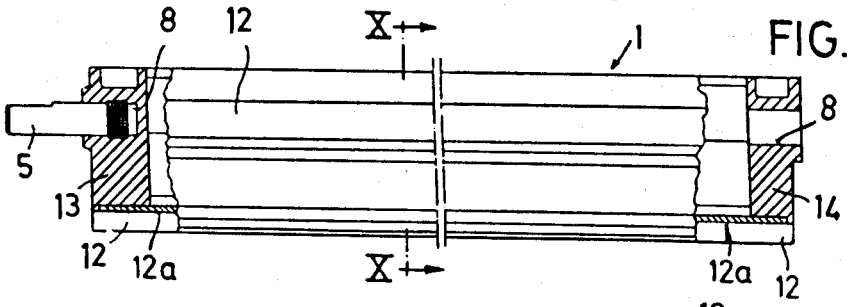
FIG. 6 shows a longitudinal side view of another embodiment of a magnetic roller, in which the end segments are shown partially cut out.
Figure 7:
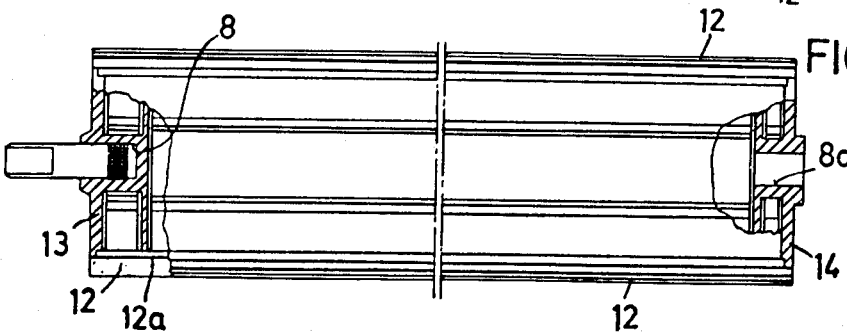
FIG. 7 shows a top view of the roller of FIG. 4.
Figure 8:
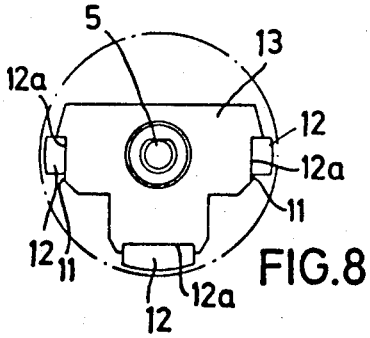
FIG. 8 shows a frontal view of the roller from the left side in FIGS. 6 and 7.
Figure 9:
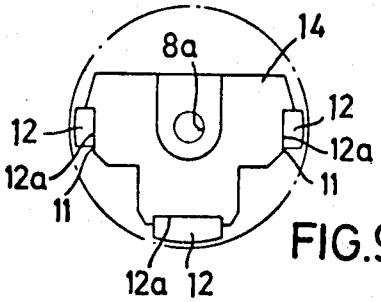
FIG. 9 shows a frontal view of the roller from the right side in FIGS. 6 and 7.
Figure 10:
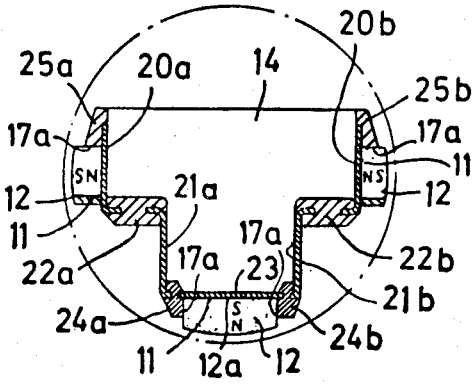
FIG. 10 shows a cross section through the roller in FIG. 6 along line X—X.

In the embodiment of FIGS. 4 and 5, carrier tube 10 has a closed rectangular profile with rounded corners, between which magnet segments 12 are arranged in a series of poles alternating at 90° from each other, and also can have variable radial thickness and also different breadths.

Hubs 14 projecting out of tube 10 have finger-like projections 17 from flange 16 aligned parallel to the longitudinal axis 10*a* of tube 10 or parallel to the rotation axis 1*a* of magnetic roller 1, which projections are arranged in pairs in an opposing spacing corresponding to the breadth of magnetic strips 12, and when the hubs are shoved in, they engage on flat surfaces 11 of tube 10 such that they serve as templates for the attachment of magnet strips 12 to tube 10.

FIGS. 4 and 5 also show that axle journal 6 or cutout 8*a* is arranged shifted to the side in hub 14 for axle journal end 6*a* and thus also rotation axis 1*a* of magnetic roller 1 in relation to symmetry axis 10*a* of tube 10, so that rotation axis 1*a* runs parallel to symmetry axis 10*a* and does not coincide with this.

In the FIGS. 6 to 10 embodiment, tube 10 of roller 1 does not consist of a closed tube profile, but rather is made of several paired opposite, parallel, profiled longitudinal strips 20*a*, 20*b*, 21*a*, 21*b*, which consist of angled sheet metal parts, and are connected by means of a tongue and groove connection at their angled edges by longitudinal profiles 22*a*, 22*b* for example of extruded material. Between the two bottom Z-shaped longitudinal strips 21*a*, 21*b*, is found a smooth sheet metal strip 23 which is also mounted by longitudinal profiles 24*a*, 24*b*, which, with side alignment surfaces 17*a*, to include a magnetic strip 12 mounted on the sheet metal strip 23 between them.

Three magnetic strips 12 of different breadth and different radial thickness displaced at 90° are mounted on flat surfaces 11 of longitudinal strips 20*a*, 20*b*, of which both top strips 12 engage on alignment surface 17*a* of side holder strips 25*a*, 25*b* of plastic or the like.

Longitudinal strips 20*a*, 20*b*, 21*a*, 21*b*, 23 as well as longitudinal profiles 22*a*, 22*b*, 24*a*, 24*b* and holder strips 25*a*, 25*b* are connected with end hubs 13, 14, of which 13 supports a stationary axle journal 5 in its cutout 8, while 14 is configured as in the embodiment of FIG. 1 with cutout 8*a* for engagement of a axle journal 6 to sheathing 2 or to its end cap 4. Both hubs 13, 14 have essentially a T-shape, on which are arranged the axle journals 5, 6 or cutouts 8, 8*a* in the middle between both side magnetic strips 12 and above the bottom magnetic strip 12.

Both hubs 13, 14 are of nonmagnetic material, but could also be as in the above embodiments and if needed have friction reducing properties. Holder strips 25*a*, 25*b* of FIG. 10 and finger-like projections 17 of FIGS. 4 and 5, could also project from both end hubs 13, 14 in the direction of the rotation of the magnetic roller, or parallel thereto.

Figure 11:
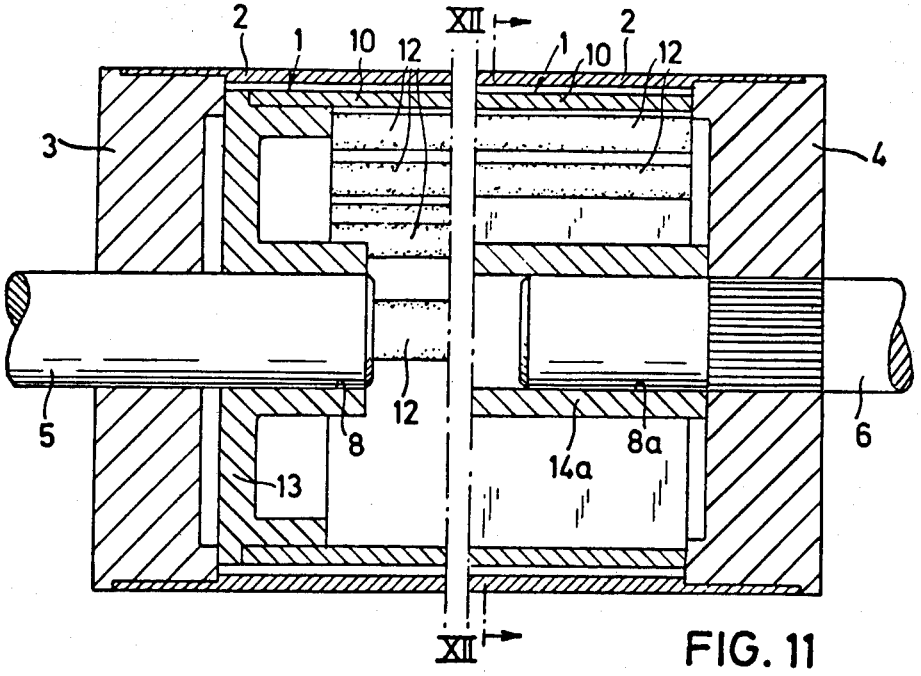
FIG. 11 shows a broken longitudinal cross section through another embodiment of the magnetic roller.
Figure 12:
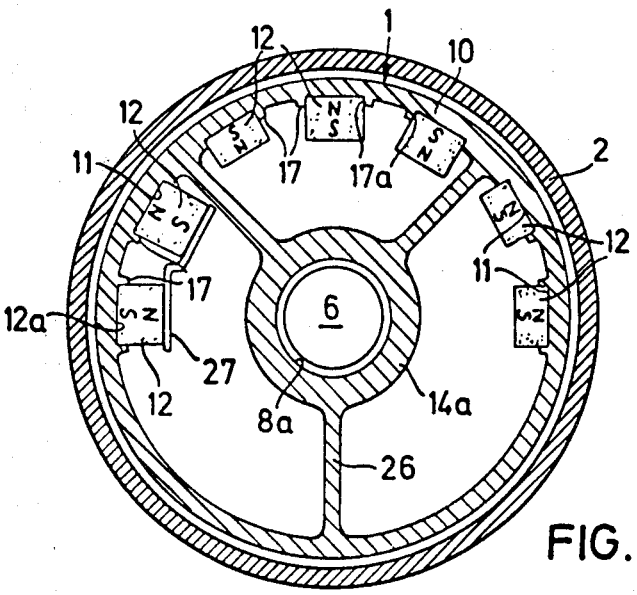
FIG. 12 shows a cross section through this roller in FIG. 11 along line XII—XII.

The embodiment of FIGS. 11 and 12 shows a magnetic roller 1 as in FIGS. 1 to 10 in a sheathing 2 with end caps 3, 4, mounted by means of pins 5, 6. The difference from the previous embodiments is that magnet segment 12 is not attached to the outside of tube 10, but rather on its inside. Tube 10 of roller 1 has for this purpose flat surfaces 11, angled opposite each other in the direction of the tube circumference, to which magnet segments 12 are attached with their flat attachment surfaces 12*a*, between inwardly directed rib-like projections 17 with side alignment surfaces 17*a*.

Tube 10 consists of nonmagnetic material such as for example, light metal or plastic, and can be configured as an injection die casting in one integral piece with a hub part 14*a* having cutout 8 or 8*a* for one of the two axle journals 5, 6, which hub includes an inner hub spider connected with the tube wall be star-shaped arms 26, as in the right half of FIG. 11 and in FIG. 12.

Instead of a one piece embodiment of tube walls and hub part 14*a*, it is also possible to configure tube 10 as a separate piece and to insert hubs 13, 14 in the open tube ends for the mounting of axle journals 5, 6 corresponding to the embodiments of FIGS. 1 to 10. The hubs could be of the closed cover or cap cover type or be configured also with openings or bars as in FIG. 12.

Strip magnet segments 12 mounted on the inside circumference of tube 10 could, as shown in FIG. 12, have a different breadth and thickness, and be distributed uniformly or nonuniformly over the inside circumference of tube 10. For reinforcement of the pole, some or even all magnetic strips 12 could be connected on their inside flat surfaces by correspondingly profiled sheet metal holder strips 27 of magnetically conductive material, as in FIG. 12.

This embodiment for magnetic rollers is particularly useful for magnetic rollers of large dimensions. After mounting of the magnet segments 12 on the inside of tube 10, no further treatment of the magnet segments is necessary.

I claim:

1. In a magnetic roller means for electrographic copying devices of the type which includes two relatively rotatable assemblies, one of said assemblies comprising a cylindrical sheath of nonmagnetic material, the other of said assemblies comprising a plurality of axially extending magnets disposed within the sheath, and means is provided for establishing said relative rotation of one of said assemblies with respect to the other of said assemblies about the axis of the sheath, the improvement which comprises a multi-element carrier means for supporting said magnets within the sheath, the carrier means being provided with means to receive shaft means disposed coaxially with the axis of the sheath and projecting inwardly from the exterior of the sheath for supporting the carrier means for said relative rotation with respect to the sheath, and a plurality of sheet metal strips, a plurality of extruded elements provided with grooves into which the ends of said strips are received in tongue and groove engagement to support the magnets and a hub at each end to support said elements and to receive said shaft means.

2. Magnetic roller means as defined in claim 1, wherein said carrier means includes an axially extending body to support said magnets, said body being disposed eccentrically with respect to the axis of said relative rotation.

3. Magnetic roller means as defined in claim 1, wherein said carrier means includes a tubular magnet supporting body.

4. Magnetic roller means as defined in claim 3, wherein said magnets comprise formed bodies of compositions including particulate high strength magnetic materials and a plastic binder.

5. Magnetic roller means as defined in claim 4, wherein said high strength magnetic materials includes particulate barium ferrite.

6. Magnetic roller means as defined in claim 4, wherein said high strength magnetic materials includes particulate alloys of rare earth metal and cobalt.

7. Magnetic roller means as defined in claim 3, wherein said magnets are spaced segmentally on said tubular body, at least one surface of a magnet being disposed in abutting engagement with a surface of the tubular body and being secured thereto by an adhesive composition.

8. Magnetic roller means as defined in claim 3, wherein said tubular body consists of magnetic material.

9. Magnetic roller means as defined in claim 3, wherein at least a portion of the surface of said tubular body extending along the length of the body is flat, one of said magnets being seated on said flat surface.

10. Magnetic roller means as defined in claim 9, wherein a plurality of peripherally related surfaces of the tubular body extending along the length of the body are flat.

11. Magnetic roller means as defined in claim 10, wherein elongated guide elements are disposed on said tubular body adjacent the sides of said magnets for aligning the magnets.

12. Magnetic roller means as defined in claim 10, wherein said magnets are provided with at least one flat surface for seating engagement with a flat surface of said tubular body.

13. In a magnetic roller means for electrographic copying devices of the type which includes two relatively rotatable assemblies, one of said assemblies comprising a cylindrical sheath of nonmagnetic material, the other of said assemblies comprising a plurality of axially extending magnets disposed within the sheath, and means is provided for establishing said relative rotation of one of said assemblies with respect to the other of said assemblies about the axis of the sheath, the improvement which comprises a multi-element tubular carrier body for supporting said magnets within the sheath, the carrier body being provided with means to receive shaft means disposed coaxially with the axis of the sheath and projecting inwardly from the exterior of the sheath for supporting the carrier body for said relative rotation with respect to the sheath, said carrier tubular body being composed of non-magetic light weight material, the inner periphery thereof provided with surfaces adapted to receive the bases of said magnets and with axially extending inwardly projecting ribs to position the magnets.

14. Magnetic roller means as defined in claim 13, wherein at least two of said magnets are connected by a sheet metal element of magnetically conductive material.

15. Magnetic roller means as defined in claim 13, wherein said tubular body includes concentric hub means to receive said shaft means, the hub means being connected with the body by a radiating spider, said body, hub means and spider being formed by extrusion.

16. Magnetic roller means as defined in claim 4, wherein said carrier means also includes a pair of hubs disposed at the respective ends of said tubular body for supporting the tubular body on said shaft means.

17. Magnetic roller means as defined in claim 16, wherein said pair of hubs comprise non-magnetic material.

18. Magnetic roller means as defined in claim 16, wherein said pair of hubs comprise friction-resistant material.

19. Magnetic roller means as defined in claim 16, wherein each of said pair of hubs are provided with a radial flange projecting outwardly a distance approximately the same as the peripheral surfaces of the magnets.

20. Magnetic roller means as defined in claim 19, wherein said hubs are provided with axially projecting guide elements extending over the outer periphery of the tubular body and adjacent the sides of the magnets.

* * * * *